United States Patent [19]

Nass

[11] Patent Number: 4,840,546

[45] Date of Patent: Jun. 20, 1989

[54] PUMP FOR LIQUIDS AND GASES

[76] Inventor: Ludvig Nass, Liljeveien 4b, S-7400 Oppdal, Norway

[21] Appl. No.: 838,396

[22] Filed: Mar. 6, 1986

Related U.S. Application Data

[63] Continuation of Ser. No. 542,172, Oct. 14, 1983, abandoned.

[51] Int. Cl.[4] ..... F04B 47/08
[52] U.S. Cl. ..... 417/403
[58] Field of Search ..... 417/390, 392, 401, 403, 417/404

[56] References Cited

U.S. PATENT DOCUMENTS

| | | | |
|---|---|---|---|
| 1,907,949 | 5/1933 | Gage | 417/403 |
| 2,245,501 | 6/1941 | Richardson | 417/403 |
| 2,260,696 | 10/1941 | Wolff | 417/403 |

*Primary Examiner*—Leonard E. Smith
*Attorney, Agent, or Firm*—Barnes & Thornburg

[57] ABSTRACT

Pump for liquids and gases, particularly for immersing in a well hole. A pump piston (35) is operated by a double acting operating piston (33) provided with working medium through a supply conduit (13). The supply of working medium to the respective sides of the operating piston (33) is controlled by a reversing valve (34). This has a slide (45) being operated by the operating piston (33).

6 Claims, 2 Drawing Sheets

Fig.2
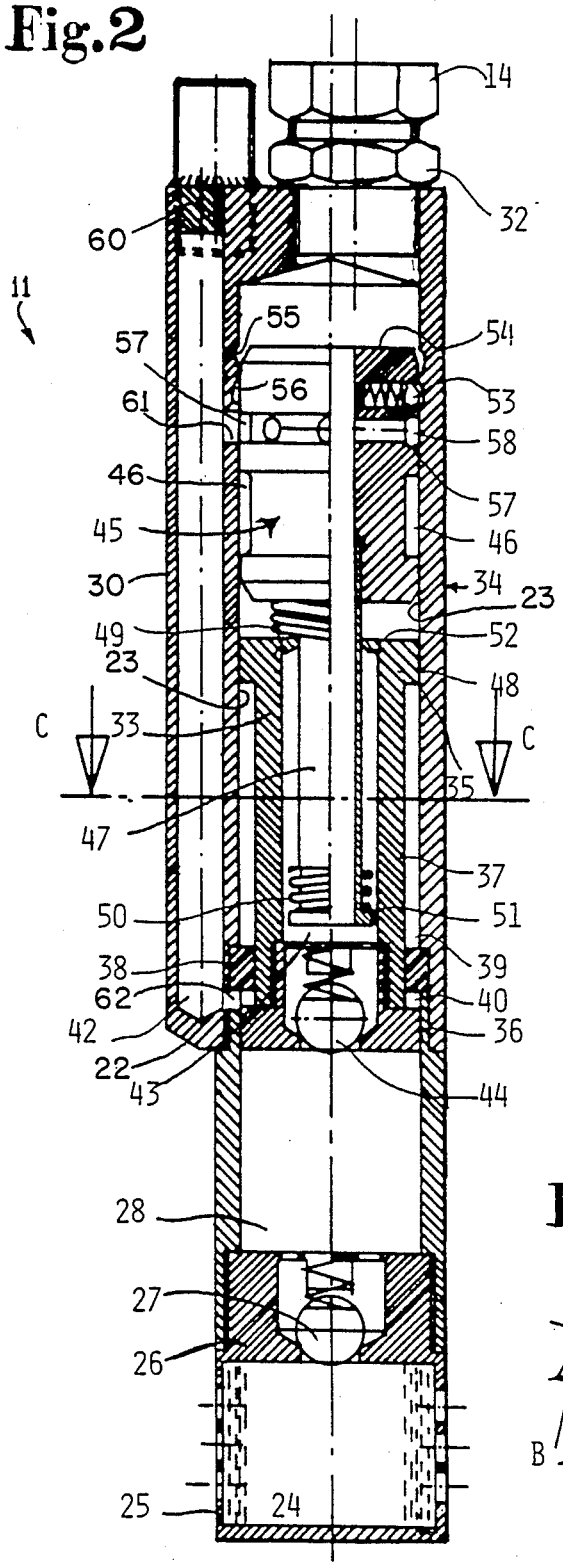
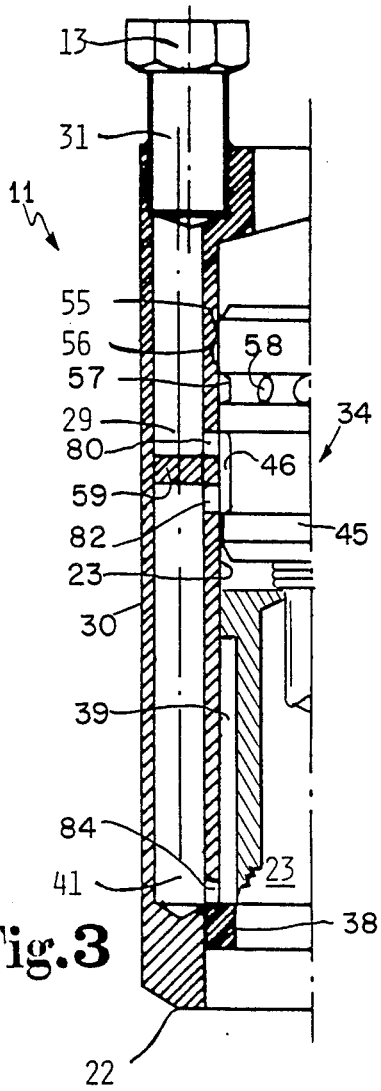
Fig.3
Fig.4
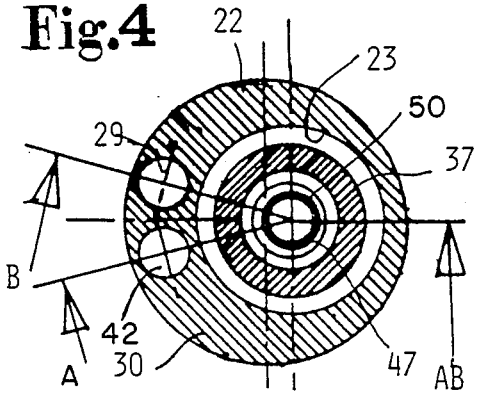

PUMP FOR LIQUIDS AND GASES

The present invention relates to an improved pump for liquids and gases, and particularly to a pump that is immersible into a well hole.

U.S. Pat. No. 1,557,116 discloses a pump, wherein the supply of working medium to the operating piston is controlled by a pilot valve arranged in a valve chamber. The known pump is arranged remotely from a hydraulic linear motor in a separate cylinder. This decreases the efficiency and increases the number of parts and the time for manufacturing. This known pump thus has a disadvantageous cost-output ratio and cannot be used for manual operation.

One object of the present invention is to provide a pump which may be used in narrow well holes and at any depth. On demand, manual operation should be possible.

The pump of the present invention may be operated by hand and can be utilized in relatively deep holes, down to 3,000–4,000 meters. This makes it possible to have water accessible at reasonable costs in areas previously without this possibility.

Additional features and advantages of the present invention will become apparent to those skilled in the art upon consideration of the following detailed description of a preferred embodiment exemplifying the best mode of carrying out the invention as presently perceived. The detailed description particularly refers to the accompanying figures in which:

FIG. 2 is an axial sectional view of the present invention taken along lines A—A of FIG. 4, with portions broken away, showing one of the fluid conduits when the sliding valve is in its lower position;

FIG. 3 is an axial sectional view of the present invention taken along lines B—B of FIG. 4, with portions broken away, showing the other of the fluid conduits when the sliding valve is in its lowered position; and FIG. 4 is a transverse sectional view taken along lines C—C through the pump of FIG. 2.

Figure 1:
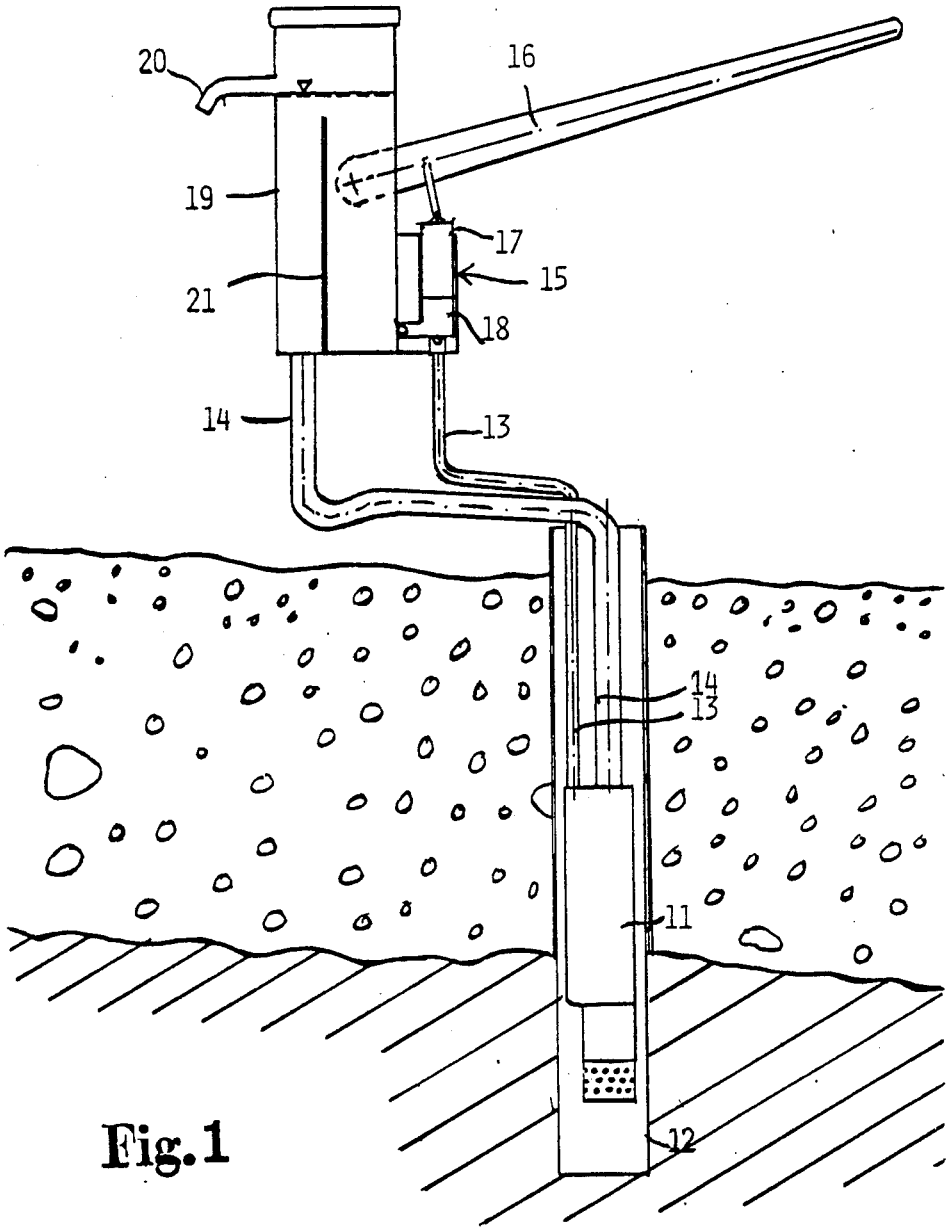
FIG. 1 shows schematically a water supply plant with a pump according to the present invention immersed in a hole drilled in the ground.

Referring now to FIG. 1, a pump 11 is immersed in a hole 12. The pump 11 is connected to a control instrument on the surface through a supply conduit 13 and an outlet conduit 14. Preferably, conduits 13 and 14 are integral and made of a plastic material.

In the illustrated embodiment, a hand-operated feeding pump 15 is provided to supply plunger piston-driving fluid to the pump 11. The hand-operated feeding pump 15 includes a handle 16 for operating a single acting piston 17 in a cylinder 18. The inlet opening for starting up fluid and the necessary valves may be of a known kind and are not shown. Integrated with the hand pump 15 is a water reservoir 19 which empties through an outlet pipe 20. A partition wall 21 is arranged in the reservoir 19 to insure water supply through the feeding pump 15.

This plant is adapted for use in areas where in the technical and/or economical base for a motor-driven feeding pump is missing. This may be the case in several economically underdeveloped rural areas in the world. However, the pump 11 may alternatively be operated with water supply from a motor-powered feeding pump.

An axial section through an embodiment of the pump 11 is shown in FIG. 2. The pump 11 is adapted for immersion into a hole with a diameter 45–60 mm. The pump in this embodiment has a generally pipe-shaped casing 22 provided with an inlet filter 24 that is screw-fitted into the casing 22. The inlet filter 24 is provided with holes 25 at the side. An endwall provided with a one-way-valve 27 is positioned within the inlet filter 24 to define an inlet chamber 28 enclosed inside the inlet filter 24.

A longitudinal channel or conduit 29 is arranged along one side of the casing 22 to extend downwardly from the upper edge. Space for the conduit 29 has been provided by arranging the cylinder bore 23 in eccentric relation to the exterior surface of the casing 22 as shown best in FIG. 4 by making a part 30 of the wall with a larger thickness. The conduit 29 is substantially narrower than the cylinder bore 23 in the same way as the supply conduit 13 is more narrow than the outlet conduit 14. For example, the relationship between the cross-sectional area of the two sections may be 1, 6 for a pump to be used in shallow holes and 1:1, 5 in the case of a deeper hole. The two conduits 13 and 14 are connected respectively to the conduit 29 at junction 31 and the cylinder bore 23 at junction 32.

The main part of the pump 11 in the illustrated embodiment is a plunger piston 33 which provides a combined operating- and pump-piston and which will be described further. The supply of plunger piston-driving fluid from the supply conduit 13 to the plunger piston 33 through the conduit 29 is controlled by a valve assembly 34 in the illustrated embodiment. The plunger piston-driving fluid will hereinafter be referred to as the "working medium". The valve assembly 34 acts as a reversing valve and will be described further. The plunger piston 33 consists of two separate pistons 35, 36. The upper piston 35 and the lower piston 36 are connected through a common, hollow piston rod 37. The piston rod 37 is journaled by a partition wall 38 to create a working chamber on each side thereof. A higher working chamber 39 and a lower working chamber 40 are shown in FIG. 2. The upper chamber 39 is connected for fluid communication to a conduit through the valve assembly 34 as shown best in FIG. 3. The lower chamber 40 is connectable for fluid communication to a conduit 42 through the valve assembly 34 in a manner to be explained below. The conduits 41 and 42 extend through the valve housing 30 as shown best in FIGS. 3 and 4.

Conduits 29 and 41 are separated by a partition 59 as shown in FIG. 3. Conduit 29 has an upper port at junction 31 for receiving the working medium from the supply conduit 13 and a lower port 80 for discharging the working medium toward conduit 41 via slide valve 45. The lower port 80 is positioned in proximity to the partition 59. The conduit 41 has an upper port 82 for receiving the working medium from conduit 29 via slide valve 45 when the slide valve 45 is in its lower position (FIGS. 2 and 3), and, alternatively, for discharging the working medium from conduit 41 into the cylinder bore 23 when the slide valve 45 is in its upper position (not shown). Conduit 41 also includes a lower port 84 for discharging the working medium into the upper chamber 39 to move piston 33 upwardly so as to draw ground water into inlet chamber 28.

Referring now to FIG. 2, conduit 42 is closed at its upper end by partition 60. Conduit 42 includes an upper port 61 for receiving the working medium from conduit 29 via slide valve 45 when the slide valve 45 is in its upper position (not shown) and, alternatively, for discharging the working medium from conduit 42 into the cylinder bore 23 when the slide valve is in its lower position (FIGS. 2 and 3). Conduit 42 also includes a lower port 62 for discharging the working medium into the lower chamber 40 to move piston 33 downwardly so as to force ground water contained in inlet chamber 28 toward the outlet conduit 14.

Referring now to FIGS. 2 and 3, the plunger piston 33 will move in an upward direction in the cylinder when a working medium is supplied through conduit 41 and will move in a downward direction in the cylinder when the working medium is supplied through conduit 42. The control of the supply will be described further. At this movement the plunger piston 33 will act as a pump piston. The plunger piston 33 is formed to include an axial, concentrical bore 43 and a kickback valve 44 is arranged in the lower end of bore 43. The kickback valve 44 will pass water from the inlet filter 24 toward the outlet conduit 14 when the piston 33 is moving downwards. The valve assembly 34 includes a slide valve 45 which is formed to include a first annular groove 46 and a second annular groove 57 as shown best in FIGS. 2 and 3. The slide valve 45 is movable in the cylinder bore 23 to a lower position (as shown in FIG. 2) to connect the supply conduit 29 with conduit 41 and is also movable to an upper position (not shown) to connect the supply conduit 29 with the conduit 42 via the first annular groove 46. When the supply circuit 29 is connected to one of the the conduits 41 and 42 via the first annular groove 46 in the sliding valve 45, the other of the two conduits 41 and 42 respectively is then opened to the cylinder bore 23 via the second annular groove 57 formed in the sliding valve 45. Thus, the other of the conduits is connected to the outlet conduit 14 via cylinder bore 23. This means that working medium supplied to the chambers 39 and 40 is discharged into the cylinder bore 23 in the manner described below in reference to the operation of the pump and exits together with water pumped by the plunger piston 33. The slide valve 34 is moved a short distance upwards at the end of the corresponding movement of the plunger piston 33 and correspondingly downwards at the end of the downward movement of the plunger piston 33. The upward movement is effected by direct thrust between the two parts, a coil spring 49 being arranged in between.

The downward movement is effected by a pipe-like rod 47 threadedly attached at the end of a central bore through the slide valve 34. The rod 47 extends downwardly through the bore 43 and is provided with a radial flange 51 at the free end. In order to have cooperation between this flange 51 and the piston 33, the bore 43 has a flange 52 at the upper end. The flange 52 extends radially inwardly over the flange 51. A coil spring 50 is arranged at the end of the rod 47 as shown in FIG. 2 to suppress the shock of a force transferred between the two flanges 51 and 52. A spring-biased ball 53 is mounted in a radial bore 54 to keep the slide valve 45 in either a lower operating position (shown in FIGS. 2 and 3) or an upper operating position (not shown). The spring-biased ball 53 is extendable sidewards from the slide valve 45 to engage selectively one or another of an upper and a lower annular groove 55 and 56 respectively. The movement of the slide valve 45 corresponds to the vertical distance between the annular grooves 55 and 56. Alternatively, the ball 53 may also have another biasing member.

As mentioned above, the slide valve 45 is provided with a second annular groove 57 with outlets 58 radially in communication with a bore 48 through the slide valve 45 as shown best in FIG. 2 to let water from the conduit 42 into the cylinder bore 23.

The partition wall 38, which can be prepared of a plastic material, may be inserted between an upper and a lower part of the casing 22, which are interconnected by threads. The lower piston 36, enclosing the kickback valve 44, is suitably connected to the lower end of the piston rod 37 by threads.

The pump according to the present invention may be manufactured of different materials. Most of the parts may be molded or otherwise prepared from a plastic material. When manufactured for use on larger depths it may be suitable to use metal, e.g. alluminum, for some parts.

The pump in the illustrated embodiment is also provided with sealings and other sealants of a known kind.

In operation, a pressurized working medium enters the supply conduit 13 and conduit 29 in response to operation of feeding pump 15. One pumping cycle will be explained in the following paragraphs. Initially, the sliding valve 45 is in its lower position wherein the spring-biased wall 53 engages annular groove 56 as shown in FIGS. 2 and 3. The working medium is discharged from conduit 29 into conduit 41 via port 80, first annular groove 46, and port 82. The working medium is then discharged from conduit 41 into upper chamber 39 via port 84 to move plunger piston 33 upwardly so as to draw ground water through the inlet filter 24 and the one-way valve 27 into the inlet chamber 28. At the same time, upward movement of the plunger piston 33 causes flange 36 to force the working medium contained in lower chamber 40 into the cylinder bore 23 in a direction toward the outlet conduit 14 via port 62, conduit 42, port 61, second annular groove 57, and outlets 58. Upward movement of the plunger piston 33 causes upward movement of the sliding valve 45 via an interconnection established by flange 52 and coil spring 49. Upward movement of the sliding valve 45 operates to cam the spring-biased ball 53 out of engagement with the first annular groove 56. Upward movement of the sliding valve 45 will then cease once the spring-biased ball 53 is moved to snap into engagement with the upper annular groove 55. This engagement operates to retain sliding valve 45 in its upper position.

Movement of the sliding valve 45 in the opposite direction to pump ground water upwardly from the inlet chamber 28 in a direction toward the outlet conduit 14 is accomplished in the following manner. When the sliding valve 45 is retained in upper position (not shown) due to engagement of the spring-biased ball 53 in the upper annular groove 55, the pressurized working medium will be conducted from the supply conduit 13 into conduit 42 via conduit 29, port 80, first annular groove 46, and port 61. Subsequently, the working medium is discharged from conduit 42 into lower chamber 40 to move the plunger piston 33 downwardly so as to force ground water contained in the inlet chamber 28 upwardly through the kickback valve 44 in a direction toward the outlet conduit 14. At the same time, downward movement of the plunger piston 33 causes flange 35 to force the working medium contained in upper chamber 39 into the cylinder bore 23 in a direction toward the outlet conduit 14 via port 84, conduit 41, and port 82. The lower circumferential chamfer of control valve 45 directs working medium discharged through port 82 into cylinder bore 23. Downward movement of the plunger piston 33 causes downward movement of the sliding valve 45 via an interconnection established by flanges 51 and 52 and coil spring 50. Downward movement of the sliding valve 45 operates to cam the spring-biased ball 53 out of engagement with the upper annular groove 55. Downward movement of the sliding valve 45 will then cease once the spring-biased ball 53 is moved to snap into engagement with the lower annular groove 56. This engagement operates to retain sliding valve 45 in its lower position. At this point the pumping cycle begins anew.

Different details in the illustrated embodiment can be modified. The reversing valve shown in a valve assembly 34 can be a pressure operated valve arranged in the wall 30 or at the feeding pump 15. In the last case, an additional supply conduit to the piston 33 will be necessary.

The pump may also be provided with a different form of valve assembly 34, being provided with three annular grooves, enabling an additional outlet conduit for the operating medium. When using such a valve it will be possible to operate the working piston with a medium different from that to be pumped.

The pump according to the present invention can also be arranged with several operating units combined. For example, two pistons of the illustrated kind can be arranged in the compound in the casing 22, the conduits 41 and 44 being connected, respectively, to a lower and an upper operating chamber for such a compound piston.

Although the invention has been described in detail with reference to certain preferred embodiments and specific examples, variations and modifications exist within the scope of the spirit of the invention as described and defined in the following claims.

I claim:

1. A pump immersible in a well hole or the like for pumping liquids and gases therefrom using a supply of pressurized working medium, the pump comprising an elongated pump housing having an inner wall formed to define a longitudinal bore, a partition mounted on the inner wall to divide the housing bore into an upper housing chamber and a lower housing chamber, the partition formed to include an aperture for the reception of a piston, the inner wall of the upper housing chamber being formed to include first, second, and third ports, a double acting piston in the bore, the double acting piston including an upper flange, a lower flange, and a hollow shaft extending therebetween, the hollow shaft being mounted for sliding movement in the partition aperture to position the upper flange in the upper housing chamber and to position the lower flange in the lower housing chamber, the hollow shaft, the partition, and the inner wall of the pump housing cooperating with the upper flange to define an upper working chamber for the reception of pressurized working medium and with the lower flange to define a lower working chamber for the reception of pressurized working medium, first conduit means for conducting pressurized working medium to the first port of the upper housing chamber, second conduit means for conducting pressurized working medium between the second port of the upper housing chamber and the upper working chamber, third conduit means for conducting pressurized working medium between the third port of the upper housing chamber and the lower working chamber, and control valve means for controlling the direction of movement of the double acting piston within the housing bore, the control valve means being mounted for sliding movement in the upper housing chamber between a lower and an upper operating position, the control valve means including first means for interconnecting the first and second conduit means to deliver pressurized working medium from the supply of pressurized working medium to the upper working chamber when the control valve means is in its lower position to move the double acting piston in an upward direction within the housing bore and second means for interconnecting the first and third conduit means to deliver pressurized working medium from the supply of pressurized working medium to the lower working chamber when the control valve means is in its upper position to move the double acting piston in a downward direction within the housing bore.

2. The pump of claim 1, wherein the inner wall of the upper housing chamber is formed to include a lower and an upper annular groove, and the control valve means includes detent means for yieldably engaging one of the lower annular groove to retain the control valve means in its lower operating position and the upper annular groove to retain the control valve means in its upper operating position.

3. The pump of claim 1, further comprising control means for interconnecting the control valve means and the upper flange of the double acting piston to move the control valve means from its lower operating position to its upper operating position in response to upward movement of the double acting piston.

4. The pump of claim 1, further comprising control means for interconnecting the control valve means and the lower flange of the double acting piston to move the control valve means from its upper operating position to its lower operating position in response to downward movement of the double acting piston.

5. The pump of claim 1, wherein the control valve means includes a slide valve formed to include a first annular groove for conducting pressurized working medium from the first conduit means to the second conduit means when the control valve means is in its lower position and for conducting pressurized working medium from the first conduit means to the third conduit means when the control valve means is in its upper position.

6. The pump of claim 5, wherein the slide valve is also formed to include a second annular groove in axially spaced relation to the first annular groove, the second annular groove conducting the working medium from the third conduit means to the upper housing chamber via the third port when the control valve means is in its lower operating position and during discharge of the working medium from the lower working chamber into the third conduit means in response to upward movement of the double acting piston.

* * * * *